United States Patent [19]

Biggar, III

[11] 4,138,944

[45] Feb. 13, 1979

[54] PRINT MODULE

[75] Inventor: Frank M. Biggar, III, Bennett Road, Woodside, Angola, N.Y. 14006

[73] Assignee: Frank M. Biggar, Jr., Hamburg, N.Y.

[21] Appl. No.: 710,148

[22] Filed: Jul. 30, 1976

[51] Int. Cl.[2] ..... B41F 13/20; B41F 13/30; B41F 13/44

[52] U.S. Cl. ..... 101/247; 101/181; 101/352

[58] Field of Search ..... 101/247, 178, 181, 182, 101/185, 207, 208, 209, 350, 351, 352, 139, 140

[56] References Cited

U.S. PATENT DOCUMENTS

| | | | |
|---|---|---|---|
| 1,519,544 | 12/1924 | McIndoe | 101/351 |
| 2,258,653 | 10/1941 | Klingelfuss | 101/351 X |
| 2,283,003 | 5/1942 | Frostad et al. | 101/182 |
| 2,690,121 | 9/1954 | Auerbacher et al. | 101/181 |
| 2,730,044 | 1/1956 | Harrison | 101/247 X |
| 2,982,204 | 5/1961 | Roehm | 101/247 |
| 3,034,429 | 5/1962 | Brodie et al. | 101/247 X |
| 3,108,536 | 10/1963 | Harrison | 101/218 |
| 3,190,218 | 6/1965 | Willard | 101/247 |
| 3,286,622 | 11/1966 | Mestre | 101/218 |
| 3,416,444 | 12/1968 | Cahn | 101/181 |
| 3,611,924 | 10/1971 | Harrison | 101/98 |
| 3,613,577 | 10/1971 | Halley | 101/247 |
| 3,762,323 | 10/1973 | Hartka | 101/350 |
| 3,880,077 | 4/1975 | Glaser et al. | 101/247 |
| 3,889,596 | 6/1975 | Thomas et al. | 101/352 |
| 3,926,114 | 12/1975 | Matuschke | 101/350 |

FOREIGN PATENT DOCUMENTS

| | | | |
|---|---|---|---|
| 2222216 | 10/1974 | France | 101/350 |

*Primary Examiner*—J. Reed Fisher
*Attorney, Agent, or Firm*—Rogers, Eilers & Howell

[57] ABSTRACT

A printing press for use in printing a continuous paper web having a fountain section and a plate section each pivotally mounted to a main frame. The fountain section includes a removable ink fountain and rotatably mounted fountain and transfer rolls, and the plate section includes a rotatably mounted plate cylinder. An impression cylinder is rotatably mounted in the main frame. The fountain section is pivotal for selective engagement and separation of the transfer roll with the plate cylinder, and the plate section is pivotal for selective engagement and separation of the plate cylinder with the transfer roll and the web supporting impression cylinder. The pivotal sections are actuated by hydropneumatic cylinders and are adjusted against mechanical stops which maintain the adjustment of the contacts between the respective cylinders and rolls. The fountain section also has adjustment and mechanical stop devices for selectively engaging and separating the fountain roll with the transfer roll. The print or plate cylinder is adjustable reciprocally along a plane such that the exchange of plate cylinders of different sizes is readily accommodated by the adjustable position of that cylinder along the mounting plane and does not require an appreciable adjustment of the rotating axis of the transfer roll.

22 Claims, 14 Drawing Figures

10
18
44
45
86
84
195
113
111
112
211
78
130
133
132
35
131
132
107
106
105
72
110
72
70
98
90
91
93
95
95
114
70
210
143
143
71
56
64
58
62
71
144
144
96
96
42
43
42
43
100
100
20
20
14
101
99
45
14
47
45
13
14
30
205
11

FIG. 14.
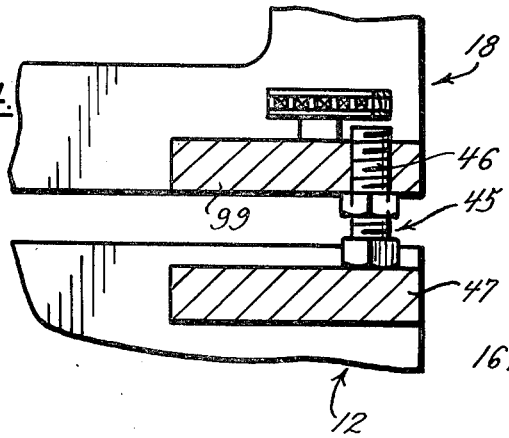
FIG. 11.
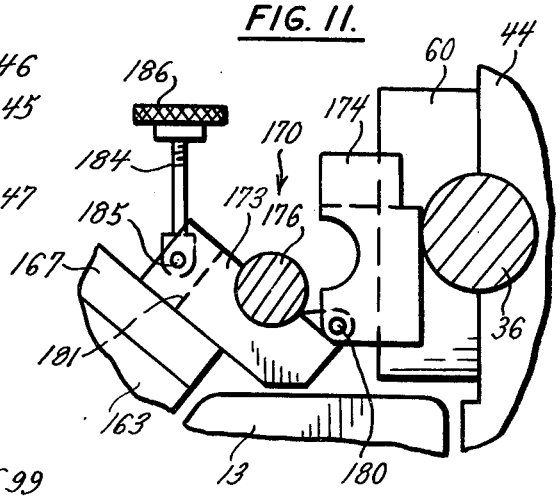
FIG. 13.
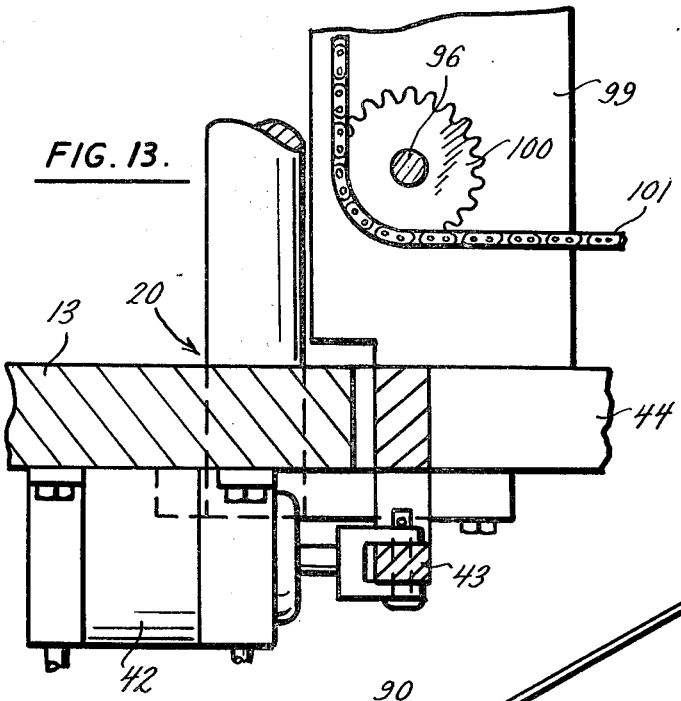
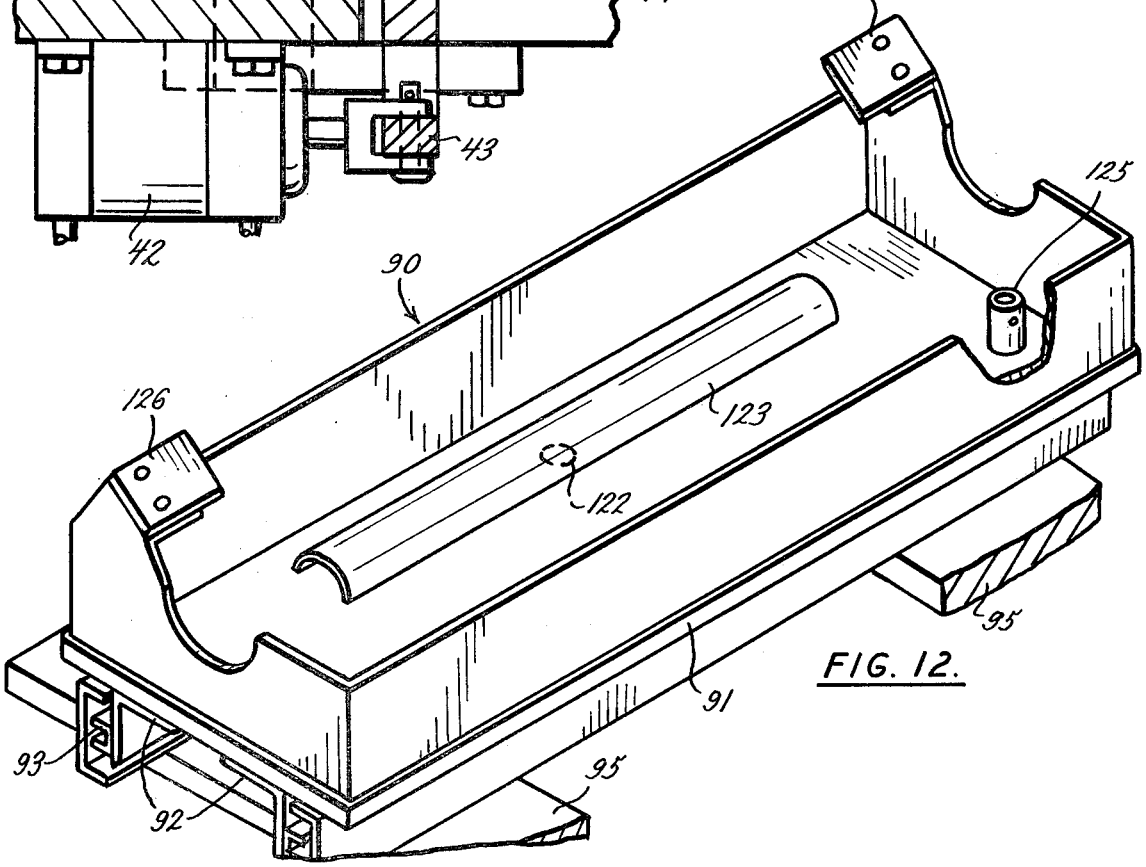
FIG. 12.

PRINT MODULE

BACKGROUND AND SUMMARY OF THE INVENTION:

In a variety of printing devices, such as rotary, intaglio, and flexographic printers, it is common to have interchangeable rolls so that a variety of printing cylinders can be accommodated. U.S. Pat. No. 3,108,536, the specification of which is incorporated herein by reference, discloses a typical device. It is also known to use pivotally mounted cylinders in printing devices to allow adjustment and movement between the cylinders. U.S. Pat. Nos. 3,286,622, 3,762,323, and 3,611,924, the specifications of which are incorporated herein by reference, are examples of such devices. Typical pivoting devices of this type operate using mechanical counterbalances and spring biasing mechanisms which are difficult to adjust and which often do not maintain proper alignment and adjustment of the cylinders during long operations. In addition, in conventional devices access to the mechanism is difficult so that cleanup of printing ink after a run is cumbersome and time consuming.

Moreover, the conventional systems which permit interchanging the printing cylinders require that additional rolls be changed with the print cylinder, or require a substantial adjustment of the rotating axis of the transfer cylinder in order to maintain proper contact between the various rolls and cylinders in the printing unit. Thus, the versatility of these devices is limited, particularly in the variations in sizes of plate cylinders that can be used in the same printing unit, and the adjustment and changeover of plate cylinders is comparatively cumbersome.

The print module of the present invention has greatly improved access to the unit for cleaning and the like such as during the changeover of inks or on completion of a run, and accommodates a substantial range of plate cylinder sizes in the same print module without requiring the exchange of other cylinders or a substantial adjustment in their axes of rotation. These advantages are achieved by the use of pivotal fountain and plate sections mounted to a frame, which sections may be pivoted for selective engagement and separation of certain cylinders relative to others. These sections include actuating and adjustable stop means which may be preset to define the degree to which the respective cylinders are separated and contacted. The fountain section includes a removable ink fountain readily accessible for cleaning and the like.

Additionally, the plate cylinder is mounted within the pivotal plate section for adjustable movement of its axis of rotation along a mounting plane which is generally flat and generally bisects and is perpendicular to a plane tangential to the transfer and impression cylinders at the same side of these cylinders as the plate cylinder.

The result is a substantial increase in versatility of the module because of the interchangeability of a large range of print cylinders, and a substantial reduction in the down time of the module due to the ready access to the mechanism for the cleaning and interchange of cylinders and other mechanisms. These and other advantages will be apparent from the drawing and detailed description to follow.

DESCRIPTION OF THE DRAWING:

FIG. 11 is a side elevation view similar to FIG. 6 of the plate cylinder mounting portion of FIG. 6 with the split bearing block of the plate cylinder shown in the open position;

FIG. 12 is an isometric view of the ink fountain used with this invention;

FIG. 13 is an enlarged view in section taken generally along the line 13—13 of FIG. 3; and FIG. 14 is an enlarged view in section taken generally along the line 14—14 of FIG. 2.

Figure 1:
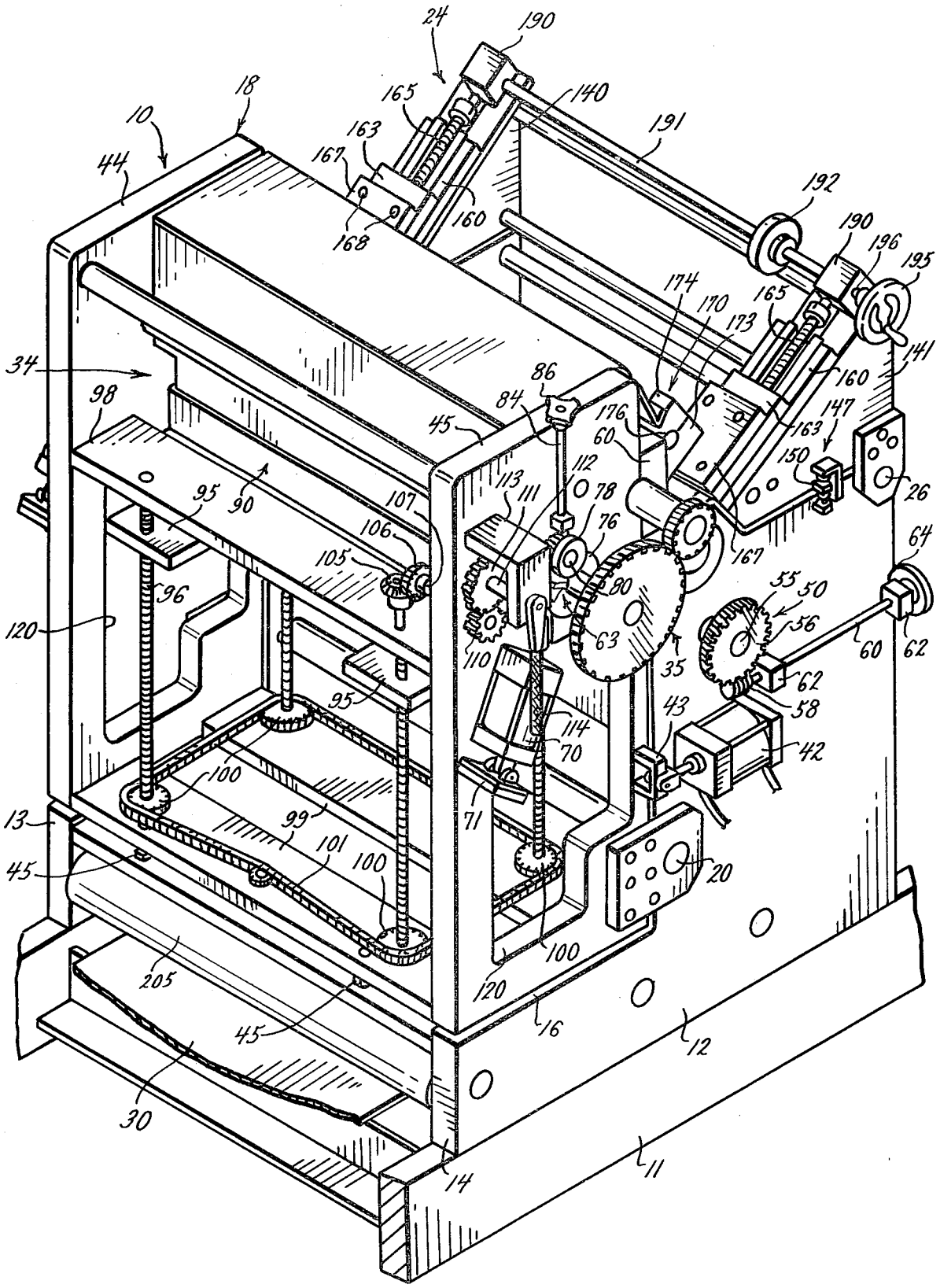
FIG. 1 is an isometric view of a print module of this invention.

DETAILED DESCRIPTION OF A PREFERRED EMBODIMENT:

In the drawing, and particularly FIG. 1, there is generally shown a print module 10 of this invention having a base 11 and a generally L-shaped main frame 12 which is composed of parallel side members 13 and 14. The frame 12 has an L-shaped cutout 16 at each side which receives an ink fountain section 18 pivotally mounted at its lower and forward end relative to the frame 12 by means of a mounting plate and pin assembly 20 located at each of its sides. There is further generally included a plate or print section 24 which is shown to be generally triangular in shape and which is pivotally mounted at its forward and lower end to the frame 12 by means of bracket and pin assemblies 26 located at each of its sides.

The purpose for the print module 10 is to print a continuous paper web 30 as may be used in the production of business forms, labels, and the like, and in the preferred embodiment, the ink fountain section generally includes an ink fountain assembly 34, a fountain roll 35, and a transfer or Anilox roll 36 which receives ink from the fountain roll 35 which in turn receives ink from the ink fountain assembly 34. The plate section 24 includes a plate or print cylinder 38 which is adjustable to contact the transfer roll 36, and the frame 12 includes an impression cylinder 40, the paper web 30 traveling over the impression cylinder 40 with the plate cylinder 38 contacting the upper surface thereof to print the desired image on the web. As will be further described, the plate cylinder 38 is mounted for adjustable movement into and out of engagement with the transfer roll 36 and impression cylinder 40 in a unique way to allow ready interchange of plate cylinders over a wide range of sizes, and the fountain section 18 and plate section 24 are pivotal within preselected limits for easy access in cleaning the module and to accommodate the slight variations in the degree of contacts between certain of these rolls and cylinders.

Figure 6:
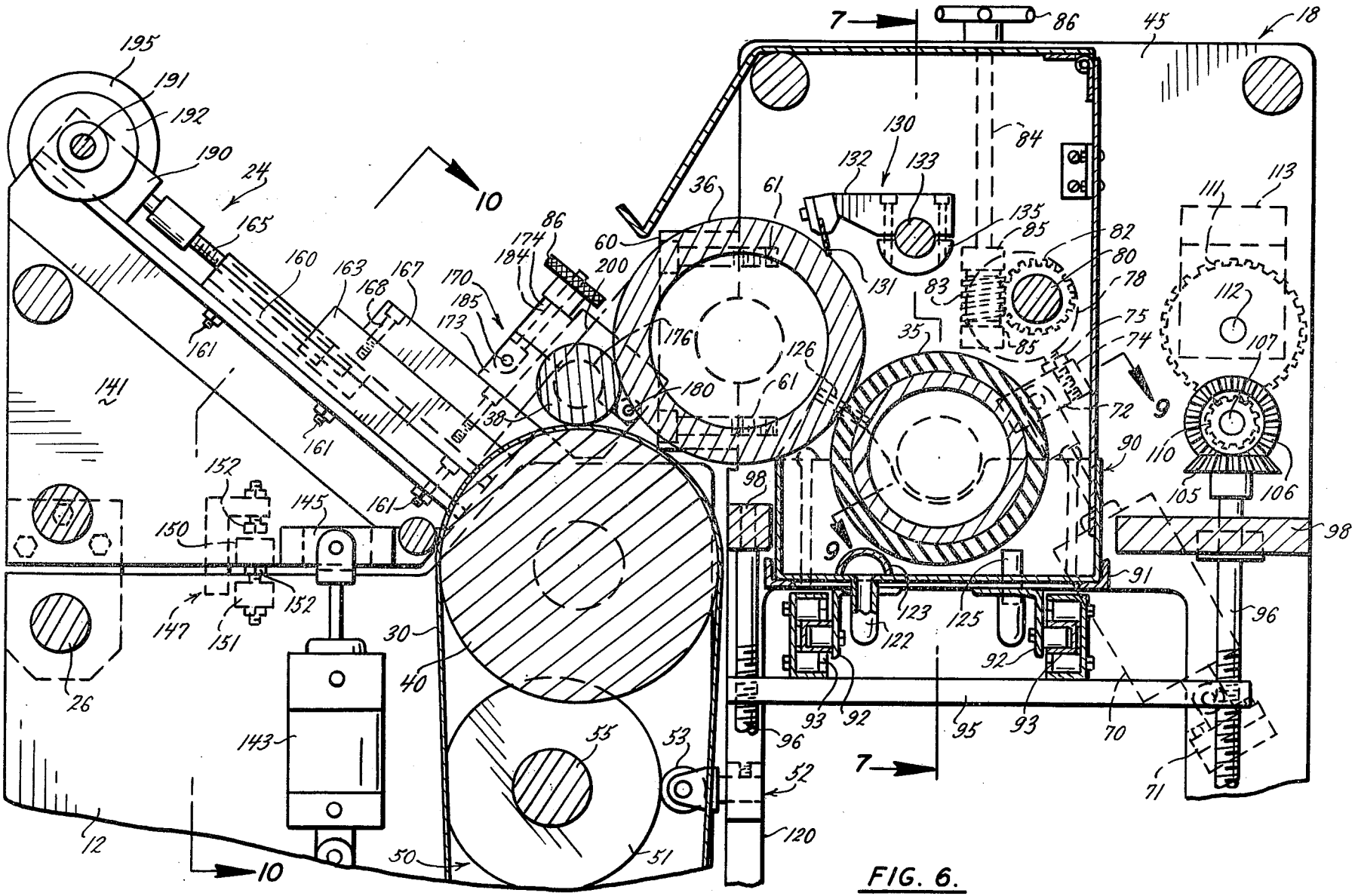
FIG. 6 is an enlarged view in section taken generally along the line 6—6 of FIG. 5.

Now more specifically, the impression cylinder 40 is rotatably mounted between the side members 13 and 14 of the frame 12 with its axis of rotation fixed and generally beneath that of the plate cylinder with the module in its operating configuration as shown in FIG. 6.

The fountain section 18 is pivotal by selective operation of hydraulic or pneumatic cylinders and pistons 42 secured to each side of the frame 12 with their piston rods pivotally connected to a suitable bracket 43 mounted to side frames 44 and 45 of the fountain section 18 and just above the pivotal axis of the fountain section. Therefore, by selective operation of the cylinder and piston assemblies 42, the fountain section 18 may be caused to pivot about its pivotal axis within certain limits as will be explained, for the purpose of selectively engaging and disengaging the transfer roll 36 with the plate cylinder 38.

To limit the rearward pivotal movement of the fountain section 18, stops 45 are mounted to the frame 12 and fountain section 18 at the lower rear end of the fountain section. These stops are shown in FIGS. 2, 3, 4, and 14 and comprise adjustable screws 46 threadedly engaging the lower end of the fountain section 18, and an opposed abutting plate 47 secured to the frame 12 at each side of the module.

To selectively limit the forward pivotal movement of the fountain section 18, there is included a cam adjust assembly 50 at each side of the module. Each such assembly 50 includes a cam 51 rotatably mounted to the frame 12 above the pivot 20 and inside the frame 12. A cam follower 52 is mounted to the side members 44 and 45 of the fountain section 18 directly opposite the cam 51. The follower 52 includes a wheel 53 which rides against the cam and which is threadedly mounted into a suitable bracket secured to each side member of the section 18. The cam 51 is mounted to the frame 12 by a shaft 55 which extends through the side member of the frame. The cam is rotatably adjustable by means of a worm gear 56 mounted to the shaft 55 externally of the frame and which engages a worm 58 mounted on a shaft 60 which in turn is rotatably mounted within suitable brackets 62 secured to the sides of the frame 12. A knob 64 is secured to the end of the shaft 60. Relatively coarse adjustment of the assembly 50 can be achieved by adjustment of the cam follower 53 while relatively fine adjustment is achieved by turning the knob 64 through the worm drive 56 and 58 which imparts rotation to the cam 51.

Figure 4:
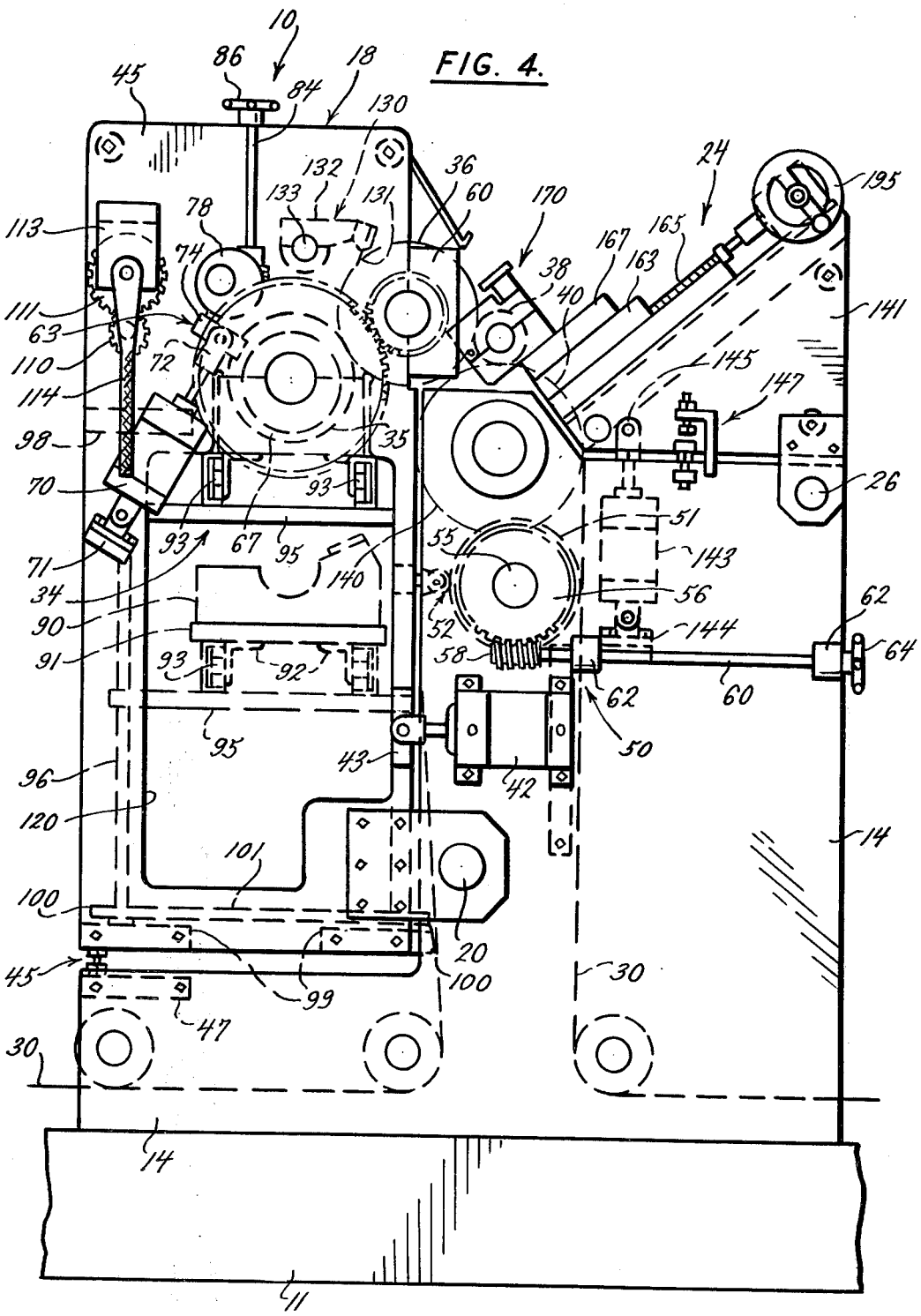
FIG. 4 is a front side elevation view of the print module of FIG. 1.

Thus, actuation of the cylinders 42 to extend its piston rods imparts pivotal movement to the section 18 counterclockwise as viewed in FIG. 4 about the pivot 20, which rearward pivotal movement is selectively limited by presetting the stops 45. Actuation of the cylinders 42 to retract the piston rod causes pivotal movement in the clockwise direction as viewed in FIG. 4 about the pivot 20, which pivotal movement is selectively limited by preadjustment of the stop assemblies 50. As will be further explained, the purpose of this pivotal movement is to provide selective engagement and disengagement of the transfer roll mounted therein with the plate cylinder. the extent of this pivotal movement may, for example, be approximately .060 of an inch.

Figure 8:
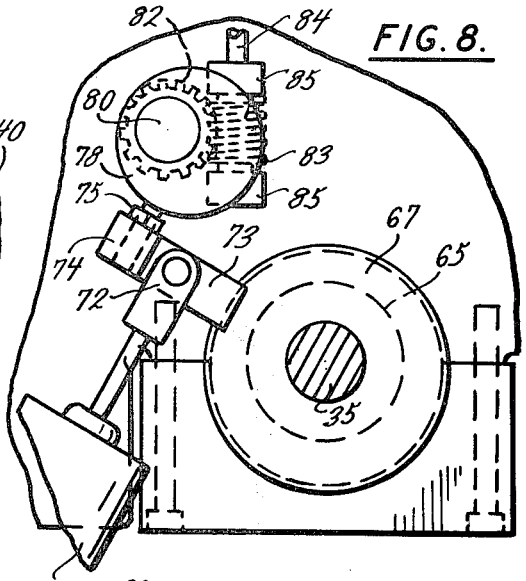
FIG. 8 is a view in section taken generally along the line 8—8 of FIG. 7.
Figure 9:
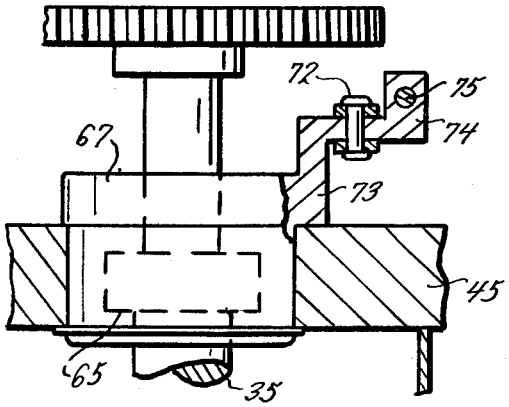
FIG. 9 is a view in section taken generally along the line 9—9 of FIG. 6.
Figure 7:
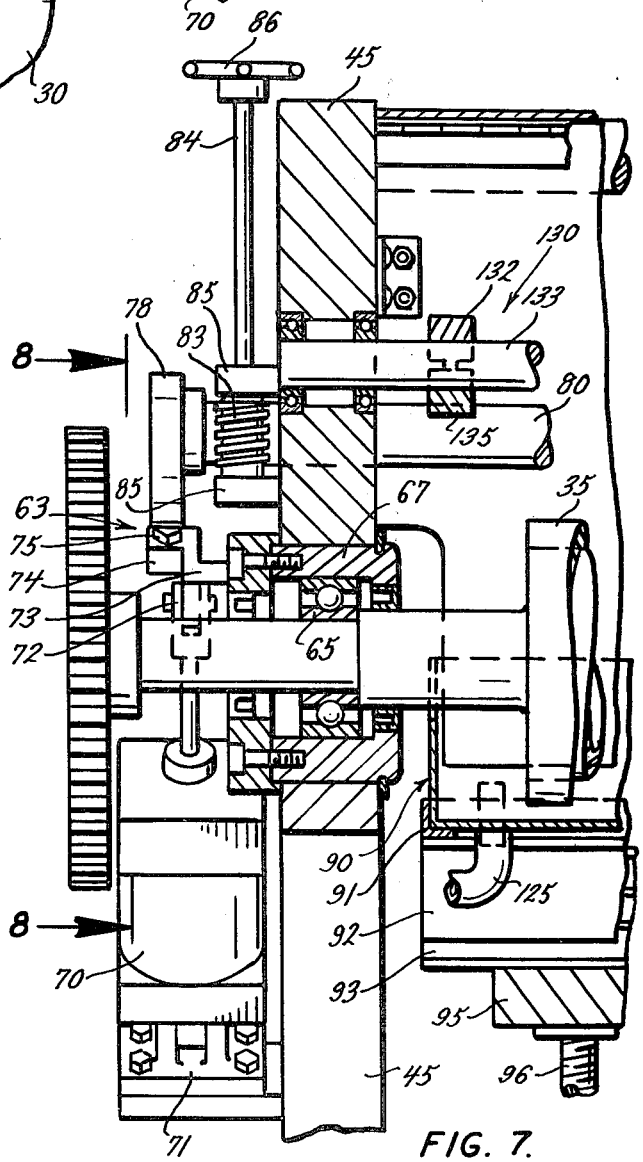
FIG. 7 is a view in section taken generally along the line 7—7 of FIG. 6.

The Anilox or transfer roll 36 is rotatably mounted between the side members 44 and 45 of the fountain section 18 near the upper and forward ends thereof by means of bearing blocks 60 clamped to the members 44 and 45 by means of bolts 61, the rotating axis of the transfer roll 36 being fixed relative to the fountain section 18. The fountain roll 35 is also rotatably mounted in the section 18 with its axis of rotation beneath and behind that of the transfer roll 36. Unlike the axis of the transfer roll, the axis of the fountain roll 35 is adjustable by means of a cam adjustment assembly 63 at each side of the module (FIGS. 7 through 9). This adjustment allows for selective engagement and disengagement of the fountain roll 35 with the transfer roll 36. With specific reference to FIG. 7, the shaft of the fountain roll 35 is rotatably mounted by suitable bearings 65 within an eccentric sleeve 67 which in turn is rotatably mounted within the side members 44 and 45 of the fountain section 18. Hydraulic or pneumatic cylinders 70 are mounted to the side members 44 and 45 externally thereof with the cylinder pivotally mounted at one end by a suitable mounting bracket 71 to the side member of the section 18, and its piston pivotally mounted by a suitable bracket 72 to the eccentric sleeve 67. The bracket 72 has an arm portion 73 attached to the sleeve 67 and an arm portion 74 with a stop member 75 attached thereto. The assembly 63 includes a further cam 78 eccentrically mounted on a shaft 80 which in turn is rotatably mounted in the side member of the section 18. A worm gear 82 is secured to the shaft 80 between the side member and the cam 78 and is driven by a worm 83. The worm 83 is mounted on a shaft 84 which is rotatably mounted within blocks 85 secured to the side member of the section 18. A knob 86 is attached to the top end of the shaft 84.

In operation of the assembly 63 it can be seen that actuation of the cylinders 70 to either extend or retract the piston rod imparts rotation to the eccentric sleeves 67 to which the brackets 72 are attached, to thereby move the rotating axis of the fountain roll 35 toward and away from the rotating axis of the transfer roll 36. The degree of rotation of the eccentric sleeve 67 to move the axis of rotation of the fountain roll 35 toward the transfer roll is limited by limitation on the extension of the piston rod. This extension is selectively limited by preadjustment of the cams 78 by turning the knob 86, the cam 78 engaging the stop members 75. In this way the degree of contact between the fountain and transfer rolls can be finely adjusted and preselected, and yet the fountain roll can be readily disengaged from the transfer roll for cleaning and the like by simple actuation of the cylinders 70.

The fountain section 18 also includes the ink fountain assembly 34 which contains the supply of ink for the module. The fountain assembly 34 includes a fountain or pan 90 which is supported within a base frame 91 which in turn is supported on transverse angle members 92. The angle members 92 are secured to drawer slides 93 which in turn are supported at each end on plates 95 running fore and aft of the section 18. The plates 95 threadedly engage lead screws 96 located at each end of the plates 95. The upper ends of the lead screws 96 are rotatably mounted in transverse plates 98, and the bottom ends of the lead screws 96 are rotatably mounted in transverse plates 99, the plates 98 and 99 being secured to the side members 44 and 45 of the fountain section 18. Also secured to the bottom end of the lead screws 96 are gears 100 which are driven together by means of a chain drive 101.

The upper end of one of the lead screws 96 has secured thereto a bevel gear 105 which engages another bevel gear 106 mounted to a shaft 107 extending through one of the side members of the section 18. A gear 110 is secured to the shaft 107 externally of the frame member and engages another gear 111 secured to a shaft 112 extending into the frame member and also into a mounting bracket 113 which is secured externally to the side member. A handle 114 is attached to the outside end of the shaft 112.

Thus, by rotating the handle 114, the lead screws 96 are rotated through the gear drives 111, 110, 106, 105, 100, and 101. This causes the plate members 95 and the fountain tray 90 supported thereon to move up and down on the lead screws. By operation of the handle 114 the fountain tray 90 can be positioned to transfer ink to the fountain roll 35 as shown by the position of the fountain tray by solid lines in FIG. 4, or can be lowered out of contact with the fountain roll as shown by the dashed lines of FIG. 4 for sliding movement of the fountain tray 90 transversely and through one of the openings 120 in the side members 44 and 45 for easy access such as for cleaning and the like.

With particular reference to FIG. 12, it will be noted that the fountain tray 90 has an inlet port 122 with a semi-circular member 123 lying thereover so that ink fed therethrough is deflected by the member 123 to prevent excessive agitation. There is also provided an outlet 125 and wipers 126 at each end of the fountain 90 to wipe excessive ink from the ends of the fountain cylinder 35.

There is also included a wiper assembly 130 (FIGS. 5 and 6) for the transfer roll 36 which includes a wiper blade 131 extending transversely across the transfer roll 36 for scraping excessive ink therefrom, and which is mounted in wiper support arms 132. These arms are secured to a shaft 133 by means of a clamp block 135, the shaft 133 being rotatably mounted between the side members.

The plate section 24 has generally triangular shaped side members 140 and 141 pivotally mounted by the pivots 26 to the frame 12. The plate section 24 is caused to pivot by actuation of hydraulic or pneumatic cylinders 143 secured to the inside surfaces of the frame side members 13 and 14 by means of suitable brackets 144. The end of the piston rod of the cylinder 143 is pivotally mounted by a suitable bracket 145 to the lower and rearward end of the plate section 24. Stop assemblies 147 limit pivotal movement of the section 24 in both directions. Each stop assembly 147 is located just forwardly of the cylinder 143 and includes a stop member 150 secured to each side member 140 and 141 and adjustable stop members 151 and 152 secured to the side members 13 and 14 of the frame 12. Engagement of the member 150 with the member 151 limits pivot of the section 24 in the clockwise direction as viewed in FIG. 6, and engagement of the member 150 with the member 152 limits pivotal movement of the section 24 in the counterclockwise direction as viewed in FIG. 6, which pivotal movements are caused by selective extension and retraction of the piston rods of the cylinders 143.

The top surfaces of the side members 140 and 141 are inclined upwardly and forwardly and have dovetail tracks 160 (FIG. 10) secured thereto by means of bolts 161 or the like. Sliding blocks 163 with mating dovetails ride in the tracks 160 and include protrusions 163 which threadedly receive lead screws 165. Blocks 167 are mounted on top of the slide blocks 163 such as by bolts 168, and a split bearing block assembly 170 is mounted to each of the blocks 168 for rotatably supporting the shaft of the print cylinder 38.

Figure 10:
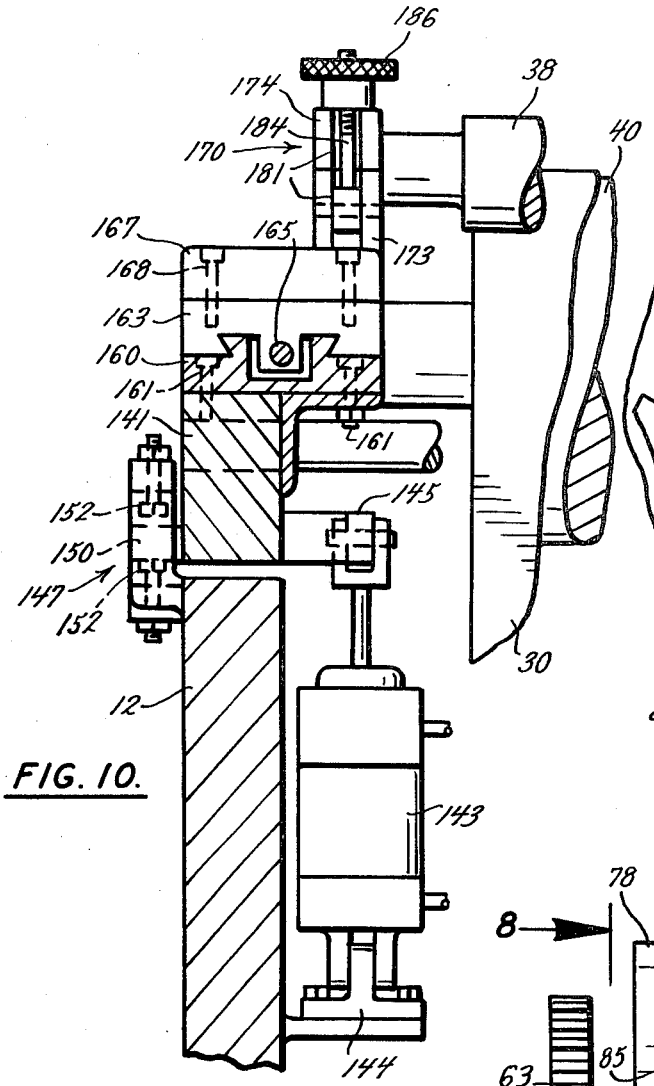
FIG. 10 is a view in section taken generally along the line 10—10 of FIG. 6.

Each of the bearing block assemblies 170 includes a lower portion 173 and an upper portion 174 having cooperating semi-circular openings for receiving the bearing 176 of the print cylinder 38 (FIGS. 6, 10, and 11). The upper portion 174 is pivotally attached to the lower portion 173 by a pin 180, with each portion having a groove 181 in the front end thereof. A threaded bolt 184 is pivotally mounted within the groove 181 of the lower portion 173 by means of a pin 185, and a threaded knob 186 engages the other end of the bolt.

Figure 5:
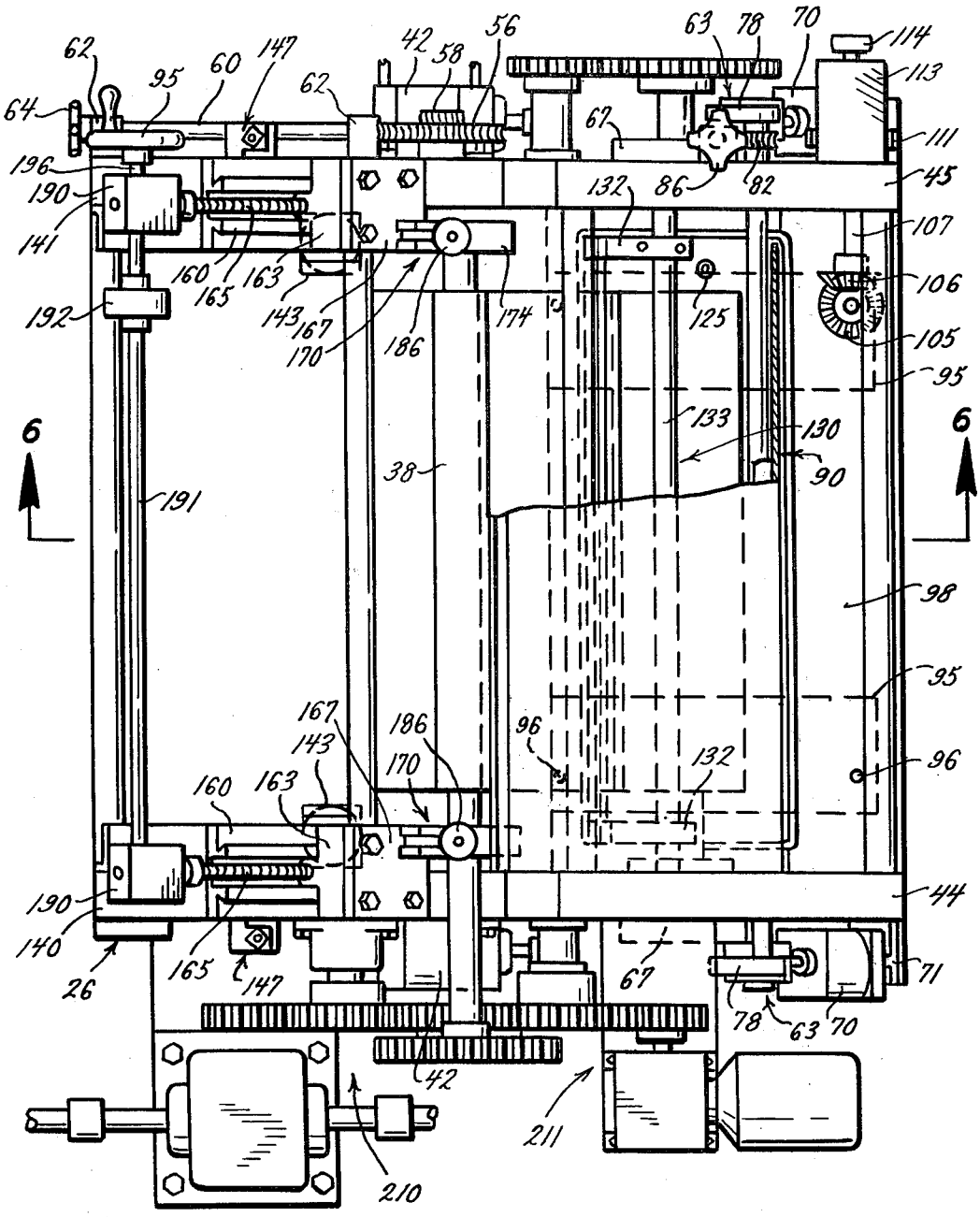
FIG. 5 is a top plan view of the print module of FIG. 1.

The other ends of the lead screws 165 extend into gear boxes 190 mounted to the upper surfaces of the side members 140 and 141 near their forward ends (FIGS. 1 and 5). A rod 191 and clutch coupling 192 extend between the gear boxes 190, and a hand crank 195 is mounted to a shaft 196 extending outwardly from one of the gear boxes. Thus, by rotation of the hand crank 195, both of the lead screws 165 are made to rotate and thereby move the slide blocks 163, bearing block assemblies 170, and the plate cylinder 38 along the tracks 160. The clutch 192 is of a type that by holding one of its members and rotating the other, a selected one of the lead screws 165 can be made to rotate for purposes of aligning the plate cylinder 38. The plate cylinder 38 can be removed or replaced with other plate cylinders of different sizes by moving the plate cylinder along the path defined by the tracks 160 and then loosening the knobs 186 so that the bolts 184 can be pivoted out of the way as shown in FIG. 11. The upper portions 174 of the bearing block assemblies 170 can then be pivoted back as shown in FIG. 11 and the plate cylinder 38 removed.

It is a feature of this invention that plate cylinders of different sizes, and within a wide range of sizes, can be readily interchanged and without requiring any significant change in the rotating axes of the other cylinders. This is accomplished by defining the path of movement of the plate cylinder along the tracks 160 as being on a flat plane generally perpendicular to and bisecting a plane 200, shown by the broken line in FIG. 6. The plane 200 is a plane tangential to the transfer roll 36 and impression cylinder 40 and at the sides of the roll 36 and cylinder 40 nearest the plate cylinder 38. In this way, regardless of the diameter of the plate cylinder 38, its movement along this defined path will allow it to simultaneously contact the surfaces of the roll 36 and cylinder 40. Actually, the path defined by the locus of axes of plate cylinders of different diameters is only flat where the roll 36 and cylinder 40 are of the same diameter. When they are of different diameters, the defined path is actually somewhat curved particularly as the plate cylinders become smaller in diameter, the curve of the path being toward the one of the cylinders 36 or 40 of least diameter. However, for practical purposes, the defined path can be along a flat plane, and any minor adjustments necessary are easily compensated by the limited pivotal movement of the plate section 24 and fountain section 18 so that the proper contact relationship is achieved between the plate cylinder 38 and the transfer roll 36 and impression cylinder 40.

Figure 2:
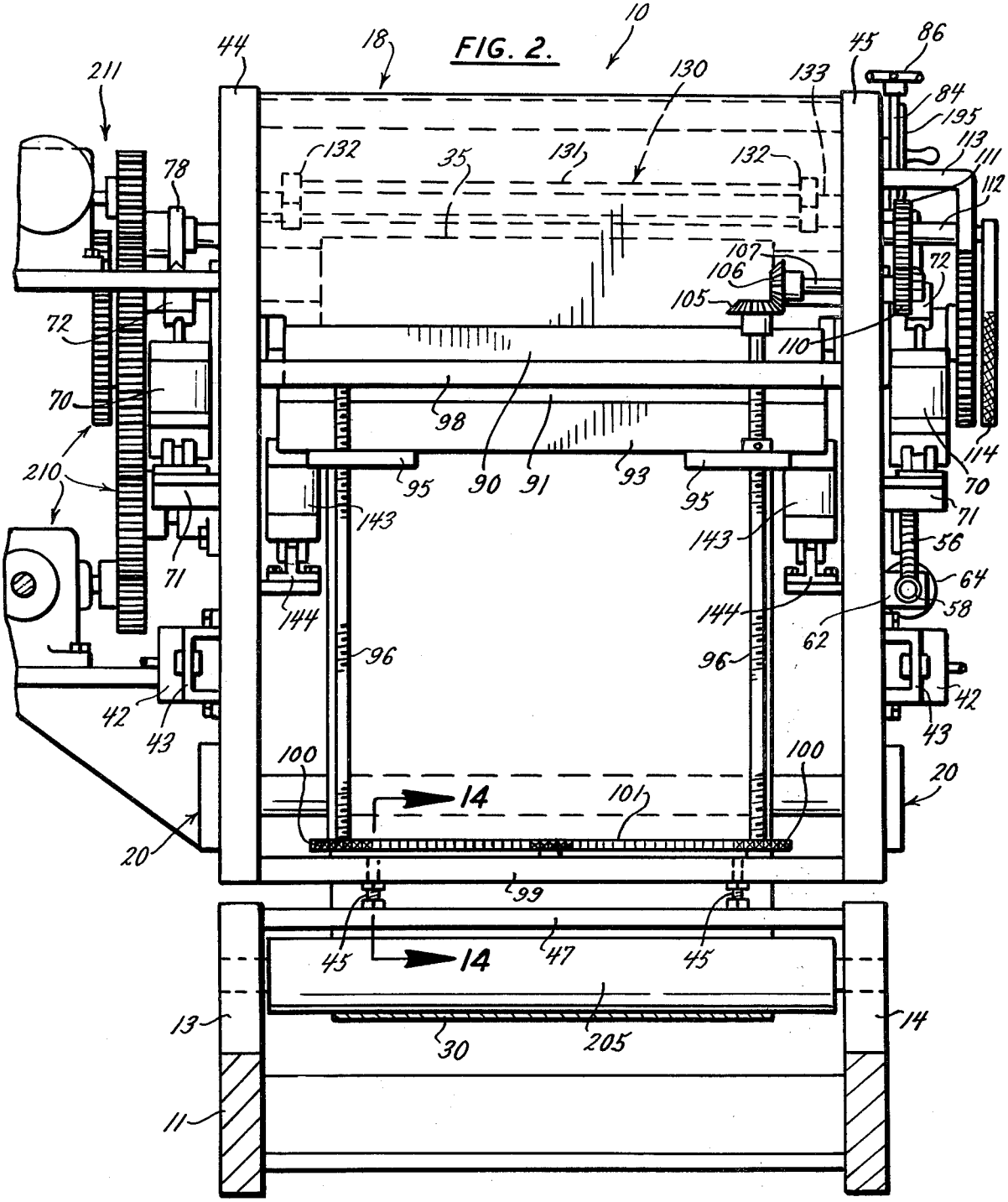
FIG. 2 is a rear elevation view of the print module of FIG. 1.
Figure 3:
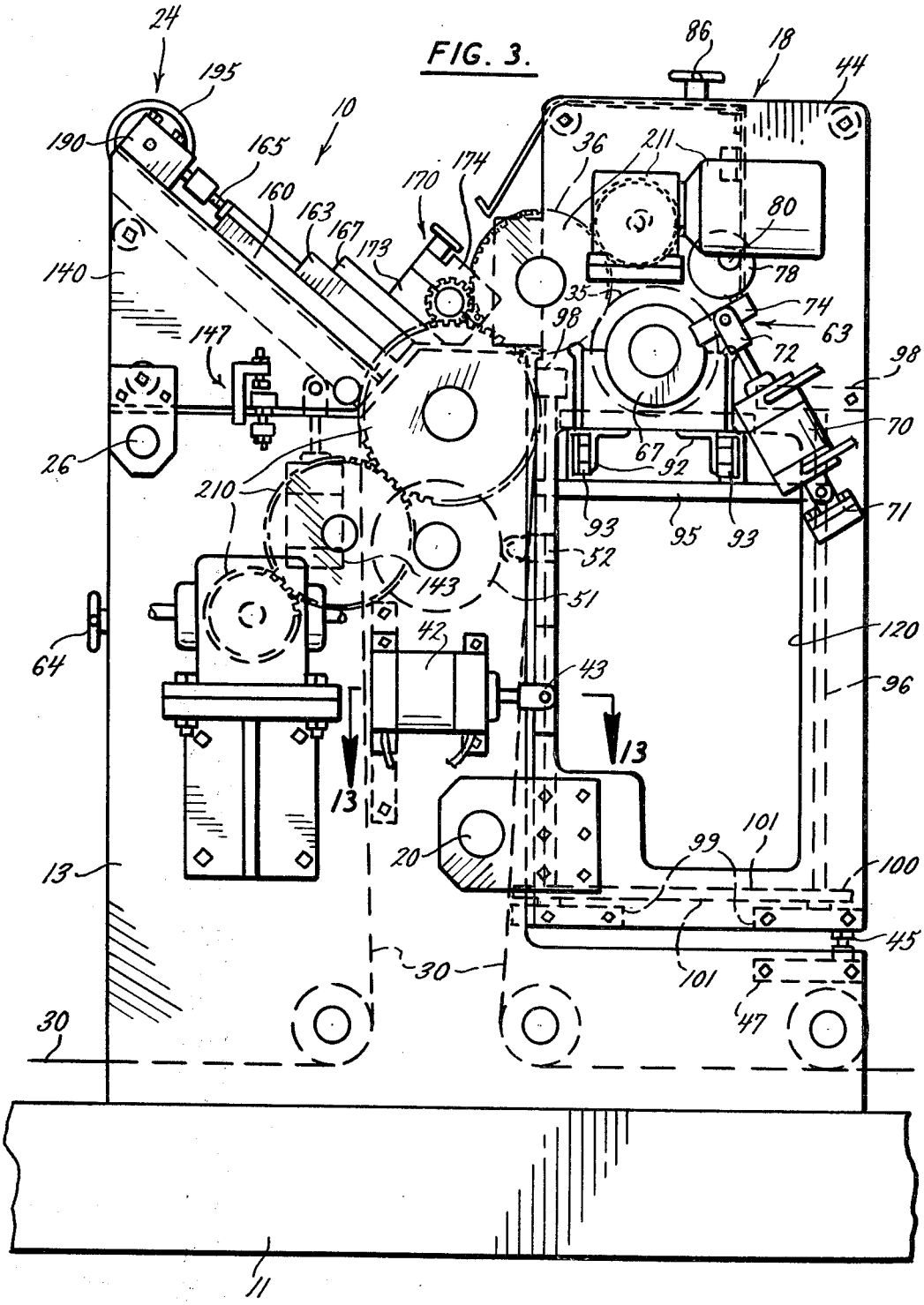
FIG. 3 is a back side elevation view of the print module of FIG. 1.

The various rolls and cylinders of the print module 10 are driven by suitable gear drives 210 and 211 (FIGS. 2, 3, and 5). A suitable clutch mechanism (not shown) is coupled between the drives 210 and 211 such that when the print module is operating to print the traveling web 30, the drive 210 is controlling and overrides the drive 211. When the module is not in full operation, but not completely shut down, as when the plate cylinder 38 is disengaged from the transfer cylinder 36, the drive 211 continues to drive the transfer roll 36 and fountain roll 35 to keep the ink from drying on these rolls.

Operation

The operation of specific subassemblies of the print module of this invention has already been described. Generally, the print module 10 is operated to feed the paper web 30 over the impression cylinder 40. With the module in full operation, ink from the fountain 90 is picked up by the fountain roll 35, transferred to the transfer or Anilox roll 36, and thence transferred to the plate cylinder 38. The particular print defined by the surface of the plate cylinder 38 is then printed on the web 30 as it passes between the plate cylinder and impression cylinder.

Between operations, such as for cleaning or changing plate cylinders, the fountain roll 35 can be moved out of contact with the transfer roll 36 by operation of the cam adjust assemblies 63 as heretofore described. Also, the fountain 90 can be selectively brought into and out of ink transferring relationship with the fountain roll 35 by operation of the crank 114 and then may slide through the openings in the side members of the section 18 for easy access for cleaning and the like. Additionally, the entire fountain section 18 is selectively pivotal about the pivot 20 for selective engagement and disengagement of the transfer roll 36 with the plate cylinder 38 in the manner heretofore described. The separation of the transfer cylinder from the plate cylinder need only be a few thousandths, such as approximately 0.060 of an inch, although less or greater separation could be provided, for easy access to the transfer roll for cleaning and the like, and to accommodate the interchange of plate cylinders over a relatively wide range such as from 7 to 24 inches in diameter.

With the fountain section 18 pivoted to disengage the transfer roll from the plate cylinder, the plate section 24 may be pivoted to disengage the plate cylinder from the web 30 overlying the impression cylinder 40. This separation may also be approximately 0.005 to 0.010 of an inch although greater or lesser separation may be provided.

The print module 10 particularly lends itself to simple and easy interchange of plate cylinders of various sizes within a wide range of sizes. Thus, to change the plate cylinder 38, it is first moved upwardly along the tracks 160 as necessary by operation of the crank 195, and then removed from the split bearing block assemblies 170 in the manner heretofore described. A new plate cylinder is then mounted in the block assemblies 170 and the crank 195 is again operated to lower the plate cylinder into contact with the transfer roll 36 and web 30 overlying the impression cylinder 40. If exact simultaneous contact of the plate cylinder is not achieved with both the transfer roll and web 30, precise contact can be achieved by pivotally adjusting the fountain section 18 and plate section 24. Since the path of movement of the cylinder 38 is along a plane which generally bisects and is perpendicular to the plane 200, only minor adjustment of the axis of rotation of the transfer roll 36 relative to the axis of the impression cylinder 40 is necessary and can be easily accommodated by pivotal movement of the fountain section 18.

The print module of this invention possesses still further advantages. For example, it will be noted that the more critical adjustments can be made all from the operator's side and the downstream side of the module. Thus, the controls 192 and 196 for adjustment of the contact between the plate cylinder and the web are at this location. The knob 64 is also readily accessible from the same location for adjusting the contact between the transfer roll and plate cylinder. Even the knob 86 which adjusts the contact between the fountain roll and transfer roll can easily be reached. This allows the operator to make these adjustments while the machine is operating and from a position where he can see the results of these adjustments on the printed web as it comes out of the downstream side of the machine.

Still another advantage is that the fountain assembly which provides for the lowering of the fountain 90 can also be used to remove and install the relatively heavy fountain roll 35. By placing a suitable support, such as a board, between the fountain and fountain roll, the fountain roll can be disconnected from its bearings so as to be supported by the fountain and then can be lowered and removed quite easily by simply lowering the fountain and sliding it out one of the openings 120 as heretofore described.

Thus, there has been described a print module which fulfills the objects and possesses the advantages heretofore stated, and which provides exceptionally ready access to its various components for cleaning, interchanging plate cylinders of different sizes, and the like.

Various changes and modifications may be made in this invention, as will be readily apparent to those skilled in the art. Such changes and modifications are within the scope and teaching of this invention as defined by the claims appended hereto.

What is claimed is:

1. A rotary printer for printing a traveling web having a frame, means in the frame for receiving a traveling web of paper therein, including an impression cylinder over which the traveling web of paper may be positioned, a print cylinder mounted above the impression cylinder to print the web received therebetween, a first subframe having an ink fountain removably supported therein, a fountain roll mounted to cooperate therewith, and a transfer roll, the transfer roll being mounted between the fountain roll to receive ink therefrom and cooperating to transfer ink to the print cylinder, the print cylinder, impression cylinder, and transfer roll being mounted with their axes parallel and being positionable to establish contact between the print cylinder and the transfer roll and between the print cylinder and the impression cylinder simultaneously, the print cylinder being mounted on a second subframe having an upper inclined plane on which said print cylinder is reciprocally mounted for movement into and out of engagement with generally the top of said impression cylinder and the web positioned therebetween and also into and out of engagement with the transfer roll, the first and second subframes having means to pivot the subframes relative to said frame to selectively engage and disengage the transfer roll, print cylinder, and impression cylinder, said second subframe being pivotal at a location to move said print cylinder generally downwardly and upwardly in an arced path toward and away from said impression cylinder.

2. The device of claim 1 wherein the print cylinder is mounted in bearings supported on dovetail mounts which are slidingly reciprocable in the printer.

3. The device of claim 2 wherein the printer has adjustable screw means to selectively reciprocate the sliding dovetail mounts.

4. The printer of claim 1 further comprising means for moving said print cylinder generally along a plane generally bisecting and perpendicular to a plane tangential to said transfer and impression cylinders at the side of said transfer and impression cylinders nearest the print cylinder.

5. The printer of claim 4 further comprising means for selectively interchanging said print cylinder with other print cylinders of various sizes.

6. The printer of claim 5 wherein said means for interchanging said print cylinders further comprises split bearing blocks for mounting the print cylinder in the second subframe.

7. The printer of claim 6 wherein the means for moving the print cylinder along said plane further comprises track means, and means for mounting said split blocks of said print cylinder for sliding movement along said track means.

8. The printer of claim 7 further comprising screw adjust means for selectively sliding said blocks along said tracks.

9. The printer of claim 1 further comprising adjustable means to set and maintain the contact between the transfer roll, print cylinder, and impression cylinder.

10. The printer of claim 9 wherein said adjustable means comprises cam adjust means for selectively presetting the degree of contact between said transfer roll and print cylinder.

11. The printer of claim 10 further comprising cam adjust means for selectively presetting the degree of contact between said fountain roll and said transfer roll.

12. The printer of claim 1 further comprising means for mounting said ink fountain for sliding movement through said frame for ready access.

13. The printer of claim 1 wherein said first sub-frame is pivotal at a location to move said transfer roll generally fore and aft in an arced path toward and away from said print cylinder.

14. A rotary printer for printing a traveling web having a frame, means in the frame for receiving a traveling web of paper therein including an impression cylinder over which the traveling web of paper may be positioned, a first subframe having an ink fountain removably supported therein, a fountain roll mounted to cooperate with said ink fountain for transferring ink from the ink fountain to the fountain roll, and a transfer roll, the transfer roll being mounted between the fountain roll to receive ink therefrom and a print cylinder to transfer ink thereto, a second subframe having a print cylinder mounted therein, said second subframe defining an upper inclined plane on which said print cylinder is reciprocally mounted for movement into and out of engagement with generally the top of said impression cylinder and the web positioned therebetween, said inclined plane generally bisecting and perpendicular to a plane tangential to said transfer and impression cylinders at the side of said transfer and impression cylinders nearest the print cylinder, the print cylinder, impression cylinder, transfer roll, and fountain roll being mounted with their axes parallel and being positionable to establish contact between the print cylinder and the transfer roll and between the print cylinder and the impression cylinder simultaneously, the first and second subframes having means to pivot the subframes relative to said frame to selectively engage and disengage the transfer roll, print cylinder, and impression cylinder, said second subframe being pivotal at a location to move said print cylinder generally downwardly and upwardly in an arced path toward and away from said impression cylinder, adjustable means to set and maintain the degree of pivot of said first and second subframes and maintain the degree of contact between the transfer roll, print cylinder, and impression cylinder, and means for selectively engaging and disengaging said fountain roll with said transfer roll.

15. The printer of claim 14 wherein the means adjusting the degree of contact between selected ones of the rolls and cylinders further comprises rotatably adjustable cams.

16. The printer of claim 14 wherein the print cylinder is mounted in bearings supported on dovetail mounts which are slidingly reciprocal within said second subframe.

17. The printer of claim 14 wherein said first subframe is pivotal at a location to move said transfer roll generally fore and aft in an arced path toward and away from said print cylinder.

18. A rotary printer for printing a traveling web having a frame, means in the frame for receiving a traveling web of paper therein including an impression cylinder over which the traveling web of paper may be positioned, a first subframe having a transfer roll mounted therein and movable therewith, a second subframe having a print cylinder mounted therein and movable therewith, said second subframe having an upper inclined plane on which said print cylinder is reciprocally mounted for movement into and out of engagement with generally the top of said impression cylinder and the web positioned therebetween, said inclined plane generally bisecting and perpendicular to a plane tangential to said transfer and impression cylinder at the side of said transfer and impression cylinders nearest the print cylinder, the print cylinder, impression cylinder, and transfer roll being mounted with their axes parallel and being positionable to establish contact between the print cylinder and the transfer roll and between the print cylinder and the impression cylinder simultaneously, the first and second subframes having means to pivot the subframes relative to said frame to selectively engage and disengage the transfer roll, print cylinder, and impression cylinder, said second subframe being pivotal at a location to move said print cylinder generally downwardly and upwardly in an arced path toward and away from said impression cylinder.

19. The printer of claim 18 wherein the print cylinder is mounted in bearings supported on dovetail mounts which are slidingly reciprocal within said second subframe.

20. The printer of claim 18 wherein said first subframe is pivotal at a location to move said transfer roll generally fore and aft in an arced path toward and away from said print cylinder.

21. A rotary printer for printing a traveling web having a frame, means in the frame for receiving a traveling web of paper therein, including an impression cylinder over which the traveling web of paper may be positioned, a print cylinder mounted above the impression cylinder to print the web received therebetween, a first sub-frame having a transfer roll mounted therein for movement therewith, the print cylinder, impression cylinder, and transfer roll being mounted with their axes parallel and being positionable to establish contact between the print cylinder and the transfer roll and between the print cylinder and the impression cylinder simultaneously, the print cylinder being mounted on a second sub-frame having means to reciprocate the print cylinder into and out of contact with the impression cylinder and transfer roll, the first and second subframes having means to pivot the sub-frames relative to said frame to selectively engage and disengage the transfer roll, print cylinder, and impression cylinder, said second sub-frame having an upper inclined plane on which said print cylinder is reciprocally mounted for movement into and out of engagement with generally the top of said impression cylinder and the web positioned therebetween, said second sub-frame being pivotal at a location to move said print cylinder generally downwardly and upwardly in an arced path toward and away from said impression cylinder.

22. The printer of claim 21 wherein said first frame is pivotal at a location to move said transfer roll generally fore and aft in an arced path toward and away from said print cylinder.

* * * * *